US005415100A

United States Patent [19]

Tolley

[11] Patent Number: 5,415,100

[45] Date of Patent: May 16, 1995

[54] APPARATUS AND METHOD FOR SETTING MISSILE FUZE DELAY

[75] Inventor: Kevin C. Tolley, Farnham, England

[73] Assignee: Base Ten Systems, Inc., Trenton, N.J.

[21] Appl. No.: 171,648

[22] Filed: Dec. 22, 1993

[51] Int. Cl.[6] ..... F24C 11/06

[52] U.S. Cl. ..... 102/276; 102/206; 102/218; 361/251

[58] Field of Search ..... 102/206, 215, 218, 276; 361/251

[56] References Cited

U.S. PATENT DOCUMENTS

| | | | |
|---|---|---|---|
| Re. 333,004 | 8/1989 | Kirby et al. | 102/200 |
| 3,098,448 | 7/1963 | Gisser et al. | 102/276 |
| 3,568,601 | 3/1971 | Morrow | 102/215 |
| 3,844,217 | 10/1974 | Ziemba | 102/276 |
| 3,861,312 | 1/1975 | Held et al. | 102/208 |
| 3,964,395 | 6/1976 | Kaiser et al. | 102/218 |
| 3,967,557 | 7/1976 | Irish, Jr. | 102/218 |
| 3,986,457 | 10/1976 | Mountjoy et al. | 102/276 |
| 4,233,673 | 11/1980 | Cricchi et al. | 365/184 |
| 4,414,549 | 11/1983 | Wichmann | 342/16 |
| 4,445,435 | 5/1984 | Oswald | 102/215 |
| 5,119,715 | 6/1992 | Porter, Jr. et al. | 89/6.5 |

*Primary Examiner*—Ian J. Lobo

*Attorney, Agent, or Firm*—Weiser & Associates

[57] ABSTRACT

A digital-to-analog converter provides a dc voltage to a fuze setting circuit which is proportional to the desired delay to be set. A digital controller operates the digital-to-analog converter responsive to the desired firing conditions for the fuze delay circuit. A current driver associated with the digital-to-analog converter converts the applied dc voltage to a constant current source, to charge a timing capacitor of the fuze delay circuit for an initial time interval. At two discrete points during this initial charging interval, the voltage across the timing capacitor is sampled and stored. The sampled voltages are applied to a computation circuit to correct for the variations in capacitance which are represented by this difference. Such correction is used to modify the currents supplied by the current driver of the fuze setting circuit to accurately charge a second, firing capacitor to the voltage which is necessary to establish a proper decay to the desired value for detonating an associated rocket or missile.

30 Claims, 13 Drawing Sheets

APPARATUS AND METHOD FOR SETTING MISSILE FUZE DELAY

BACKGROUND OF THE INVENTION

The present invention relates generally to fuzes for projectiles of various types, and more particularly, to an improved apparatus and method for setting the delay times associated with such fuzes.

In many weapon systems, it is desirable to activate (fire) a group of relatively inexpensive projectiles (rockets or missiles) in rapid sequence. To this end, and as is conventional, each of the rockets or missiles is provided with internal electronic circuitry for establishing a delay following its firing before the rocket or missile is actually armed. Sequencing circuitry, which is also generally known, is then used to separately activate each of the rockets or missiles in desired sequence, whereupon each fired rocket or missile is armed by its respective internal electronic circuitry.

Many of the rockets or missiles which are the subject of this patent application are mass-produced from relatively inexpensive components for purposes of cost-effectiveness. However, the use of inexpensive components leads to the disadvantage that such components will be subject to widely varying values. As a result, it is not uncommon for the actual delay times established by the internal electronic circuitry of such rockets or missiles to vary widely. The inexactitude of fuze delay circuits of this general type has been recognized, and efforts have been made to improve precision.

For example, U.S. Pat. No. 3,986,457 (Mountjoy et al) discloses a fuze setting circuit wherein steps are taken to overcome the deficiencies of imprecise circuit components associated with the projectile fuze (e.g., wide tolerance capacitors) by supplying such circuitry with precision charging voltages (through precision resistors) and by monitoring circuit parameters (i.e., capacitor charging) with comparators for establishing correct levels. However, such circuitry provides no assurances that these correct levels will be established in sufficient time prior to the required detonation of the associated projectile. This is exemplified by alternative means for detonating the projectile in the event that this becomes necessary prior to a complete charging of the fuze setting circuit.

U.S. Pat. No. 3,964,395 (Kaiser et al) discloses a priming circuit for a projectile which can provide extended timing functions making use of capacitors of reduced size. This is accomplished through pulsed operations of the priming circuit, which extends the overall timing function of the circuit to that which would normally be achievable only with unacceptably large components (i.e., capacitors).

However, neither of these measures ensures an accurately set delay time in a conventional fuze delay circuit irrespective of its component values (which can often vary more than ±20% from circuit to circuit).

In order to better understand the improvements of the present invention, an explanation of the operation of known projectile fuzes (associated with the rockets or missiles to be fired) is important. For purposes of this discussion, reference will be made to exemplary fuzing for a projectile such as the HYDRA 70, Folding Fin Aerial Rocket (FFAR), which is manufactured by BEI Defense Systems Company, Inc., of Fort Worth, Tex. Such rockets can be equipped with various combinations of motor, warhead and fuze types. Some of the warheads may deploy submunitions or flachettes, and are therefore used with a time delay fuze to allow the warhead to be activated at a precise distance from the launch platform. To this end, fuzes such as the M439 Remote Set Fuze (having a military designation of MIL-F-48877) and the M433 Remote Set Fuze (having a military designation of MIL-F-63281A) are used. The M439 Remote Set Fuze is an analog fuze that provides a time delay function which is proportional to externally applied voltages, and which must be set immediately prior to rocket launch. The M433 Remote Set Fuze is similar to the M439 Remote Set Fuze, except that its components can provide the shorter time delays which are required for warheads that are to be detonated some time following their penetration of a desired target.

Portions of the M439 Remote Set Fuze which are pertinent to these discussions are illustrated in FIG. 1 of the drawings. Operations of this fuze circuit are primarily dependent upon two capacitors. A first capacitor $C_t$ provides the overall time delay function. To this end, the capacitor $C_t$ is positively charged through a diode CR1, to an energy level proportional to the required delay time. A second capacitor $C_f$ provides the energy required to activate the detonator ($R_L$). To this end, the capacitor $C_f$ is negatively charged through a diode CR2, to an energy level (e.g., of about 1,000 ergs) sufficient to activate the detonator $R_L$ following the set delay time. However, there is a considerable amount of interaction between the capacitors $C_t$ and $C_f$ which must be compensated for in order to achieve a desired timing accuracy. As will be discussed more fully below, a fuze setting circuit is provided to establish the sequence for, and the accuracy of the positive and negative charging of the capacitors $C_t$ and $C_f$ (i.e., the firing sequence).

Activation of the fuze circuit occurs when a Safe/-Arm switch SW1 is closed, generally during initial acceleration caused by firing of the motor associated with the rocket. Following this, both of the capacitors $C_t$ and $C_f$ are discharged through the resistors R1 and R2, the transistor Q1, and the (closed) Safe/Arm switch SW1. The characteristics of this discharge are exemplified in FIG. 2. Prior to activation of the fuze circuit (upon closure of the Safe/Arm switch SW1), the voltage across the capacitor $C_f$ exhibits a nominal positive level. Following activation of the fuze circuit, discharge of the capacitor $C_f$ causes a decay in this voltage level. When the voltage across the capacitor $C_t$ falls to zero, the desired delay time has been reached and the transistor Q2 is turned on. This, in turn, toggles and latches a complimentary bi-stable circuit comprised of the transistors Q3 and Q4. This then causes the transistor Q5 to conduct so that remaining charge on the capacitor $C_f$ is applied to the detonator (represented by the load resistance $R_L$), causing activation of the warhead. The precise delay time established by the fuze circuit of FIG. 1 can be determined by the following equation.

$$T=(C_x*R)*ln(1/(1-((VT-VF)/VT))) \quad (1)$$

Where:

$C_x=1/(1/C_t)+(1/C_f)$, $R=R_1+R_2$, $VT=(VC_t+VC_f)-VQ1$, $VF=((QC_f-QC_t)/C_f)-VQ1$, $QC_t=VC_t*C_t$, $QC_f = VC_f * C_f$, $VC_t$ = Voltage across $C_t$, $VC_f$ = Voltage across $C_f$, and VQ1 = Voltage drop across Q1.

Thus, the capacitors $C_t$ and $C_f$ are combined in series to define the capacitance $C_x$. The delay time is determined by calculating the charge (and thus the voltage) remaining on the capacitor $C_f$, following discharge of the capacitor $C_t$. The discharge current of the capacitors $C_t$ and $C_f$ will be identical during the discharge period. As a result, both of the capacitors $C_t$ and $C_f$ will loose an equal amount of charge.

While equation (1) would ordinarily allow for a precise determination of the fuze delay times to be established, the M439 Remote Set Fuze generally employs capacitors having tolerances of ±20% (due to cost considerations). As a result of this, the actual delay time established for arming a particular rocket can vary widely. This disadvantage is magnified by the often intended use for such rockets, that being their activation in rapid sequence.

SUMMARY OF THE INVENTION

It is therefore the primary object of the present invention to provide an improved apparatus and method for setting a fuze delay for a projectile such as a rocket or missile.

It is also an object of the present invention to provide an improved apparatus and method for setting a fuze delay which is useful in conjunction with relatively inexpensive rocket and missile types.

It is also an object of the present invention to provide an improved apparatus and method for setting a fuze delay for relatively inexpensive rockets and missiles which can achieve an accuracy for the delay time to within ±1%.

It is also an object of the present invention to provide an improved apparatus and method for setting a fuze delay for relatively inexpensive rockets and missiles with an accuracy to within ±1%, while interfacing with circuit components of unknown value.

It is also an object of the present invention to provide an improved apparatus and method for setting a fuze delay for relatively inexpensive rockets and missiles with an accuracy to within ±1% by means of a single wire interconnection.

It is also an object of the present invention to provide an improved apparatus and method for setting a fuze delay for relatively inexpensive rockets and missiles with an accuracy to within ±1%, and which can also compensate for forward voltage variations introduced by temperature and current effects associated with the fuze circuit.

It is also an object of the present invention to provide an improved apparatus and method for setting a fuze circuit in less than 40 milliseconds, to allow for ripple firing of multiple remote-set rockets and missiles.

These and other objects which will become apparent are achieved in accordance with the present invention by a missile fuze delay setting circuit which employs a digital-to-analog converter to provide a dc voltage to the fuze setting circuit which is proportional to the desired delay to be set. A digital controller operates the digital-to-analog converter responsive to the desired firing conditions for the fuze delay circuit. A current driver associated with the digital-to-analog converter converts the applied dc voltage to a constant current source, to charge the capacitor $C_t$ (of the fuze delay circuit) for an initial time interval. At two discrete points during this initial charging interval, the voltage across the capacitor $C_t$ is sampled and stored. The difference between these two sampled voltages is then a function of the value of the capacitor $C_t$. The sampled voltages are applied to a computation circuit to correct for the variations in capacitance which are represented by this difference, and resulting from variations in the voltage drops which occur across the diode CR2 and the transistor Q1 of the missile fuze circuit. Such correction is used to modify the currents supplied by the current driver of the fuze setting circuit to accurately charge the capacitor $C_f$ to the voltage which is necessary to establish a proper decay (see FIG. 2) to the desired value for detonating the rocket or missile, providing the degree of accuracy which is desired. Additional increments of current proportional to the desired delay may also be added, if desired, for charging the capacitor $C_f$ to offset the charge applied to the capacitor $C_t$.

For further detail regarding circuitry for performing the above-described functions, reference is made to the detailed description which is provided below, taken in conjunction with the following illustrations.

BRIEF DESCRIPTION OF THE DRAWINGS

In the several views provided, like reference numbers denote similar structure.

DETAILED DESCRIPTION OF A PREFERRED EMBODIMENT

Figure 1:
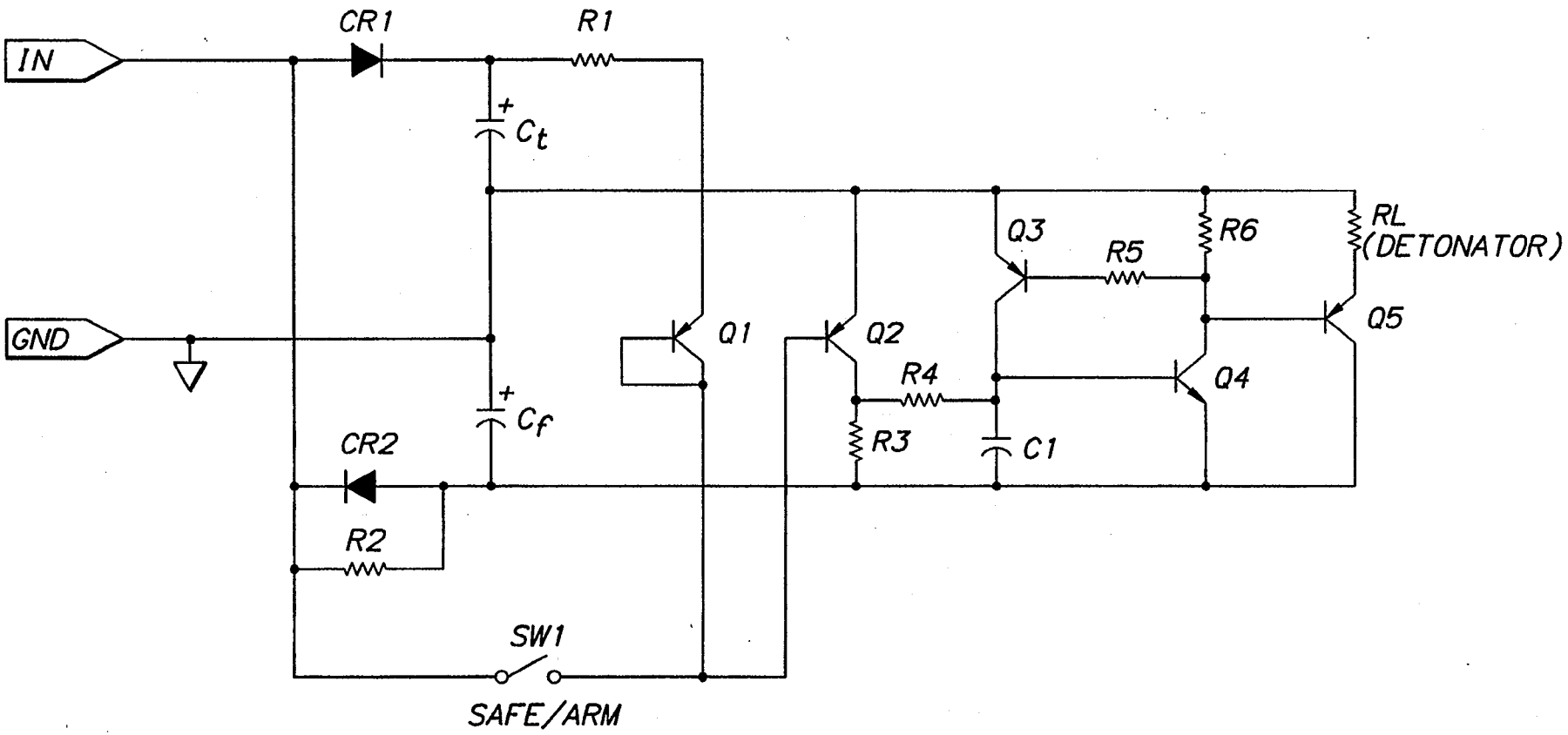
FIG. 1 is a schematic diagram of a typical fuze circuit for known rockets and missiles of various types.
Figure 2:
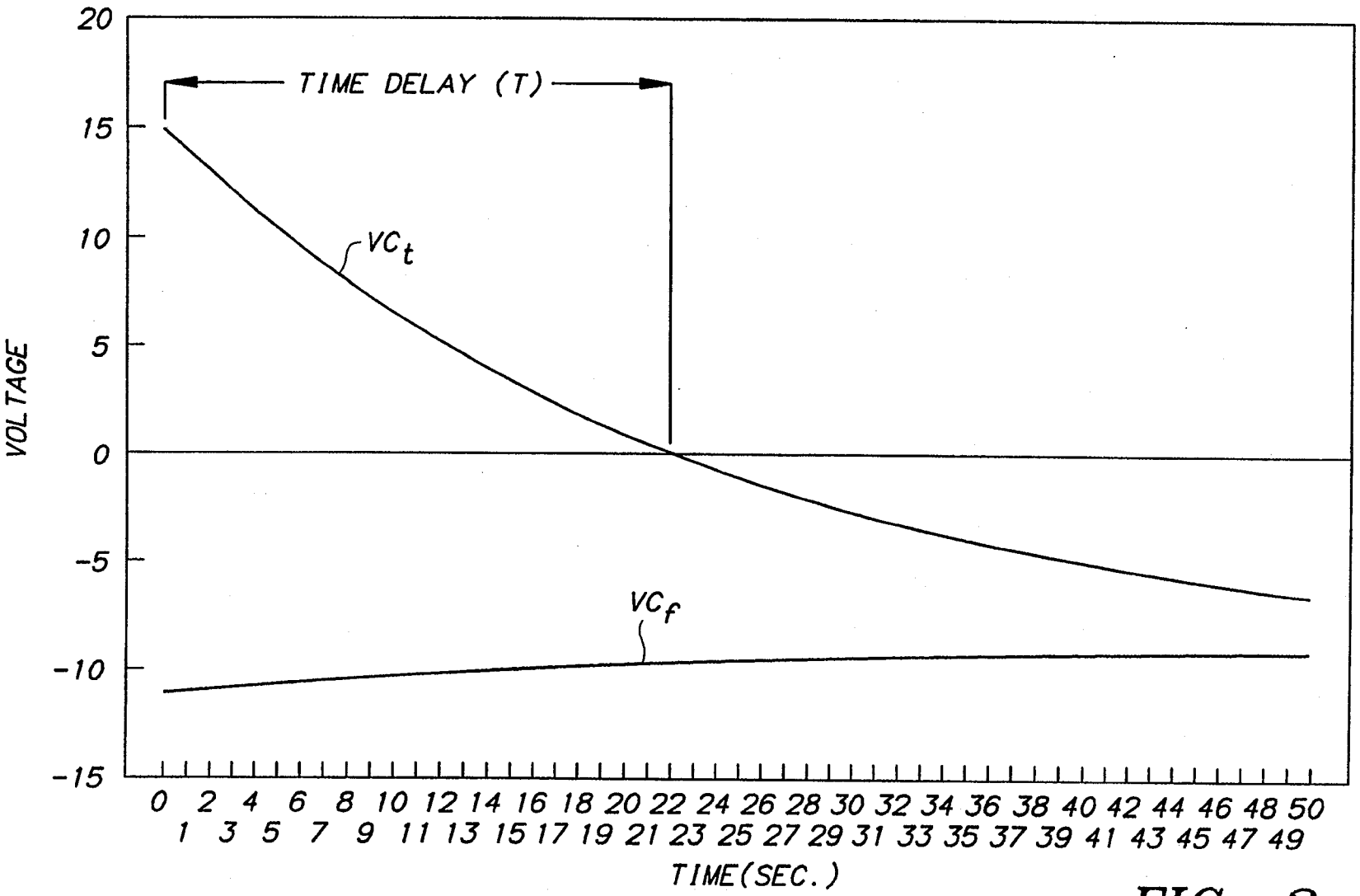
FIG. 2 is a graph showing a characteristic discharge curve representative of the timing function established by the fuze circuit of FIG. 1.
Figure 3:
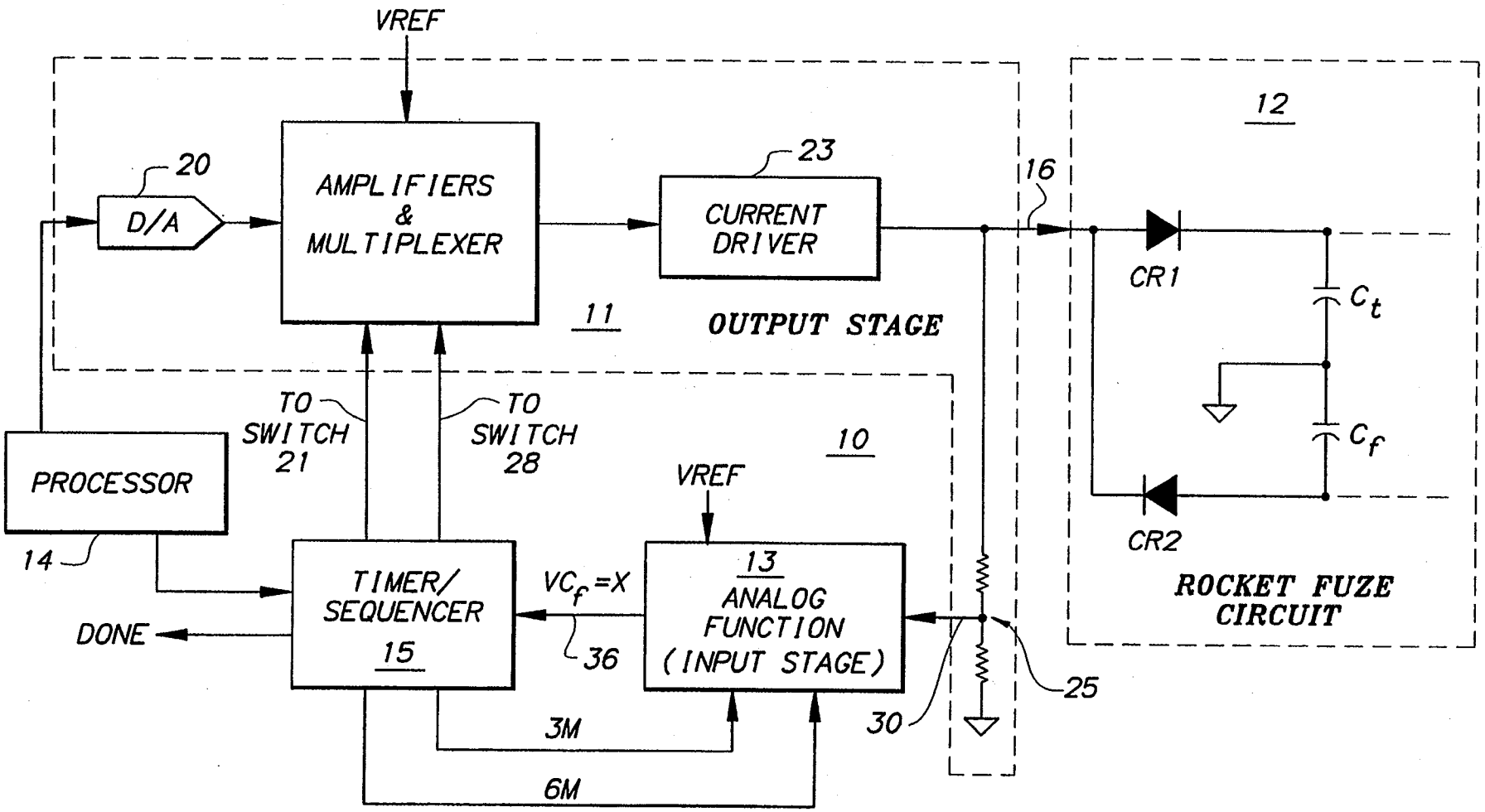
FIG. 3 is a block diagram of a fuze delay setting circuit for use in conjunction with the fuze circuit of FIG. 1.

FIG. 3 is a block diagram of a fuze delay setting circuit 10 of the present invention. To this end, an output stage 11 is electrically connected with a fuze circuit 12, for firing a rocket or missile of a desired type. An input stage 13 is coupled with the output stage 11, for controlling operations of the output stage 11 as will be discussed more fully below. To be noted is that only selected components of the fuze circuit 12 have been illustrated in FIG. 3. These components correspond to components of the fuze circuit which is more fully illustrated in FIG. 1.

Operations of the fuze delay setting circuit 10 are initiated responsive to a processor 14. To this end, the processor 14 communicates with the output stage 11, to establish (define) the delay for the fuze circuit 12, and with the input stage 13 (through the intermediary of a timer/sequencer 15), to initiate and control setting of the fuze circuit 12. These operations will each be discussed more fully below.

The processor 14 operates to supply a delay code (in conventional fashion) which serves to define the delay to be established for the associated fuze circuit. The delay code can be developed in a variety of ways such as pilot selection, from a control panel, by automated ranging apparatus, or by pre-flight programming. Generally speaking, the delay code is a function of target parameters and attack strategy, which will clearly vary from application to application. The fuze delay setting circuit 10 then operates to convert this delay code to a voltage (current) which can electrically charge the capacitors $C_t$ and $C_f$ of the fuze circuit 12 to establish, with significant accuracy, the delay time for the rocket or missile with which the fuze circuit 12 is associated.

Figure 4:
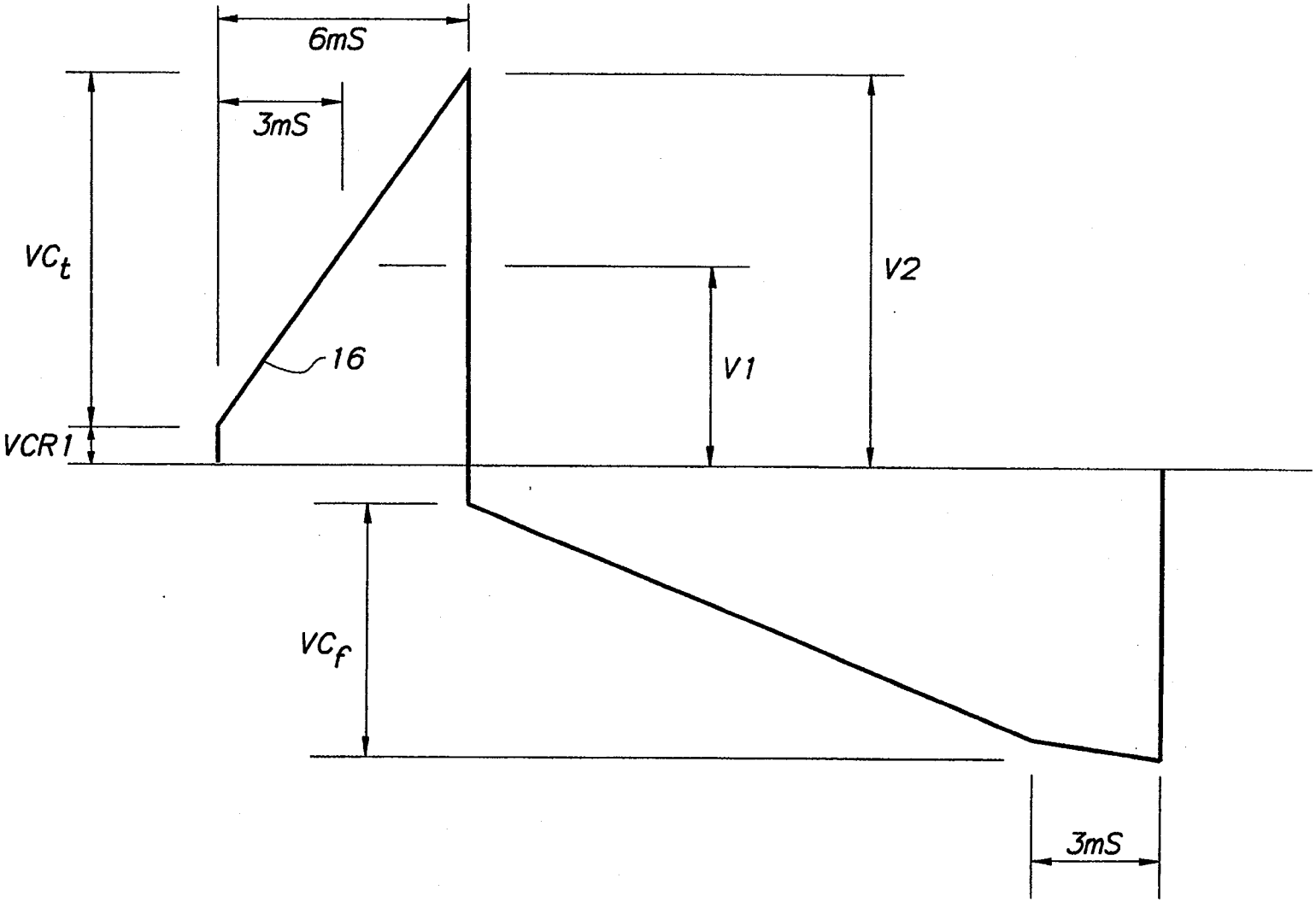
FIG. 4 is a graph showing a characteristic curve representative of operations of the block diagram of FIG. 3.

In overall operation, the circuit components of the block diagram of FIG. 3 operate to charge the capacitors $C_t$ and $C_f$ of the fuze circuit 12 as follows. Characteristic operations of the circuit components of FIG. 3 are illustrated in FIG. 4. Initially, a positive constant current is applied to the fuze circuit 12, at 16, for a specified period of time. This applied current will determine the delay time established for the fuze circuit 12. As an example, this positive current may be applied to the fuze circuit 12 for a period of 6 milliseconds, which is scaled so that 30 milliamps of charging current will provide a time delay of 25.6 seconds. Of course, such parameters may be varied to provide different timing periods, in association with different types of fuze circuits, as desired.

At two (or more) discrete points during this initial charging, steps are taken to monitor the input voltage at the fuze circuit 12 (at the node 16). These voltages are sampled and held during this initial phase of the charging procedure, and form the basis of computations which are used to monitor the actual voltage applied to the capacitor $C_t$. As an example, in conjunction with the above described 6 millisecond initial charging period, voltage samplings at 3 milliseconds and at 6 milliseconds (during initial charging of the capacitor $C_t$) are preferred.

The following equations are used to determine the voltage drop across the diode CR1, and the actual voltage applied to the capacitor $C_t$, as follows:

$$VC_t=(V_2-V_1)*2 \quad (2)$$

$$VCR1=V_1-(VC_t/2) \quad (3)$$

Where:

$V_1$=Voltage after 3 milliseconds, $V_2$=Voltage after 6 milliseconds, $VC_t$=Voltage across $C_t$ after 6 milliseconds of charging, and VCR1=Voltage drop across CR1.

Following initial charging of the capacitor $C_t$, the capacitor $C_f$ is negatively charged with a constant current that will allow the largest expected value of the capacitor $C_f$ to be charged to the maximum required voltage within the allowed setting time. Charging of the-capacitor $C_f$ is halted when the measured voltage at the node 16 is equal to the following:

$$Vin=((V_x-((VC_t/2)-((VC_t/2)*K_1)^2))+(VCR1*2)) \quad (4)$$

Where:

Vin=Voltage at fuze input, $V_x$=Fixed reference voltage, and $K_1$=Constant value.

The fixed reference voltage $V_x$ represents the average voltage that will exist (between $C_t$ and $C_f$) during the discharge period. As an example, if $V_x$ is set to 14.081 volts (nominal), an average current of 7.031 microamps is developed through the resistors R1 and R2 of FIG. 1. This average current in turn determines the fuze delay, and is equal to the charge current for the capacitor $C_t$ (e.g., 30 milliamps) divided by the ratio of the charge time (e.g. 6 milliamps) and the maximum discharge time (e.g., 25.6 seconds). In practice, $V_x$ will vary slightly from the calculated voltage, due to the effects of compensation in accordance with the present invention.

The capacitor $C_f$ is charged to a negative voltage equal to $V_x$, less the average voltage anticipated on the capacitor $C_t$ during discharge. The voltage on the capacitor $C_f$ is further modified to include a negative voltage equivalent to twice the voltage measured across the diode CR1 during charging of the capacitor $C_t$. This additional voltage will compensate for the forward voltage drop across the diode CR2 (during charging of the capacitor $C_f$), and the forward base-emitter junction voltage of the transistor Q1 (during the fuze discharge period).

As a result, the average voltage that will be present on the capacitor $C_t$ during the discharge period will be approximately equal to half of the voltage measured on the capacitor $C_t$, less the square of a constant portion of the measured voltage. The squared constant portion of $VC_t$ provides compensation for variations in value of the capacitor $C_t$ and the resulting discharge slope.

Finally, the capacitor $C_f$ is further charged, for a fixed period (e.g., 3 milliseconds) and at a current equal to a fixed portion of the current previously applied to the capacitor $C_t$. As a result, the final voltage applied to the capacitor $C_f$ is equal to the following:

$$VC_f(\text{Final})=VC_f+(I*K_2)/C_f \quad (5)$$

Where:

$VC_f$=The voltage previously applied to $C_f$,

I=The current applied to $C_t$, and $K_2$=Constant value.

The constant value $K_2$ determines the fixed portion of the current to be applied to the capacitor $C_f$ and provides compensation for the discharge slope of the capacitor $C_f$. The additional charge applied to the capacitor $C_f$ compensates for the charge lost from the capacitor $C_f$ during the fuze discharge period.

The values for the reference voltage $V_x$, and the constants $K_1$ and $K_2$, are empirical, and will depend upon the nominal capacitance of the capacitors $C_t$ and $C_f$, as well as the scale factor of the charge time and current (for the capacitor $C_t$) against the discharge time and current. Precise values for $V_x$, $K_1$ and $K_2$ may be determined by computer analysis.

Figure 5A:
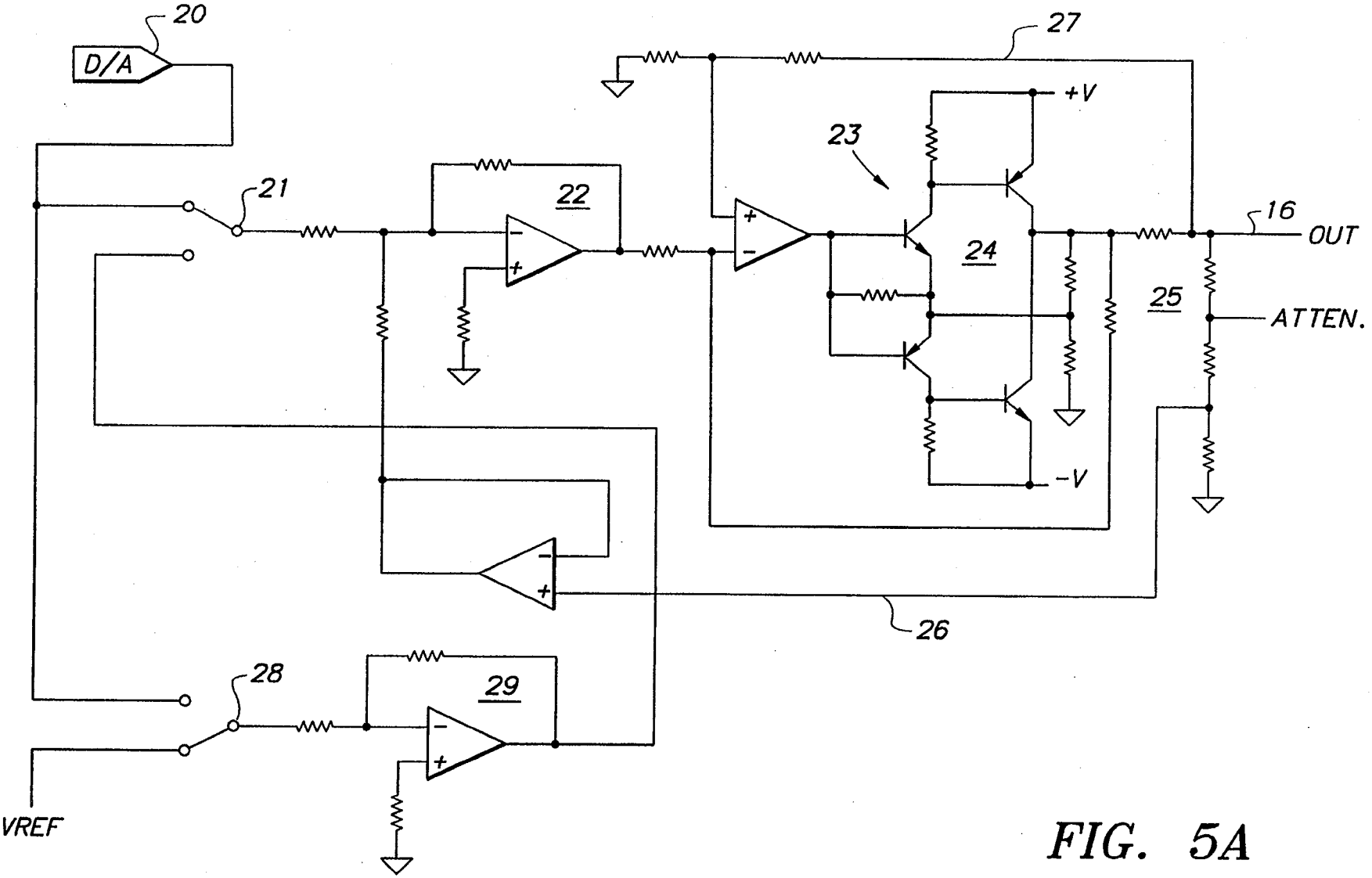
FIGS. 5A, 5B and 5C are schematic diagrams of circuitry for implementing the output stage of the block diagram of FIG. 3, showing sequential operations of the output stage.
Figure 5B:
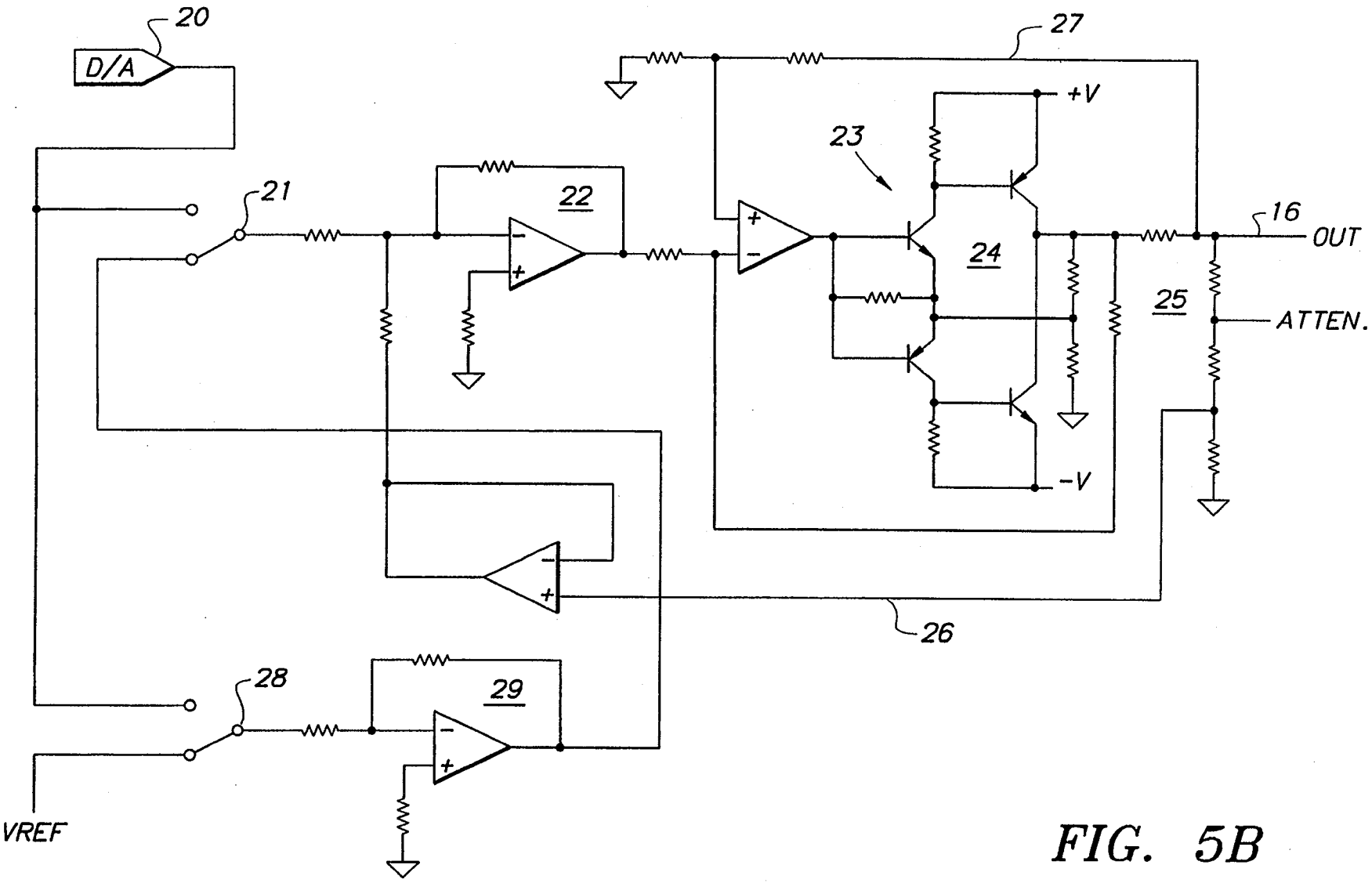
Figure 5C:
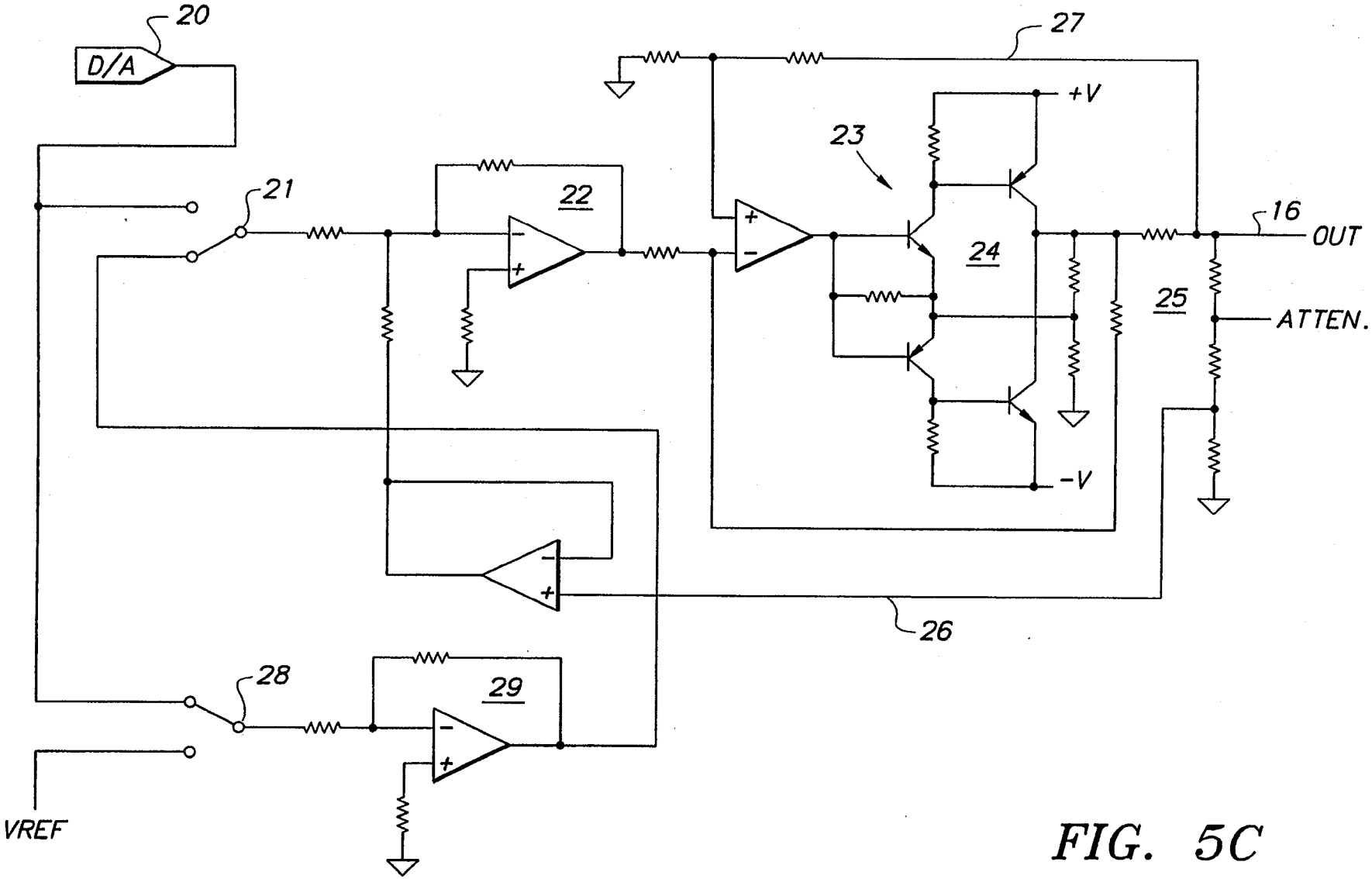
Figure 6:
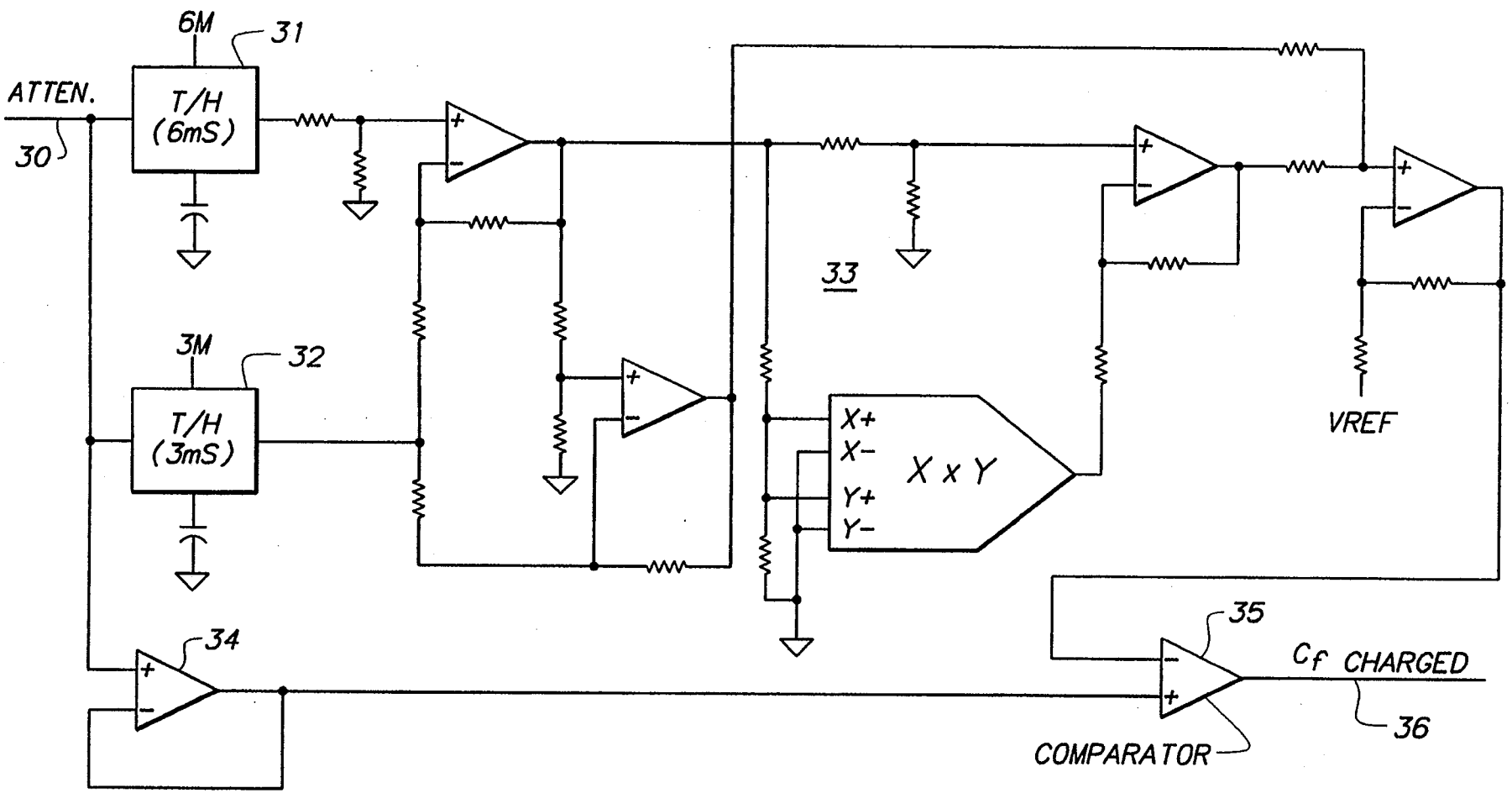
FIG. 6 is a schematic diagram of circuitry for implementing the input stage of the block diagram of FIG. 3.
Figure 7:
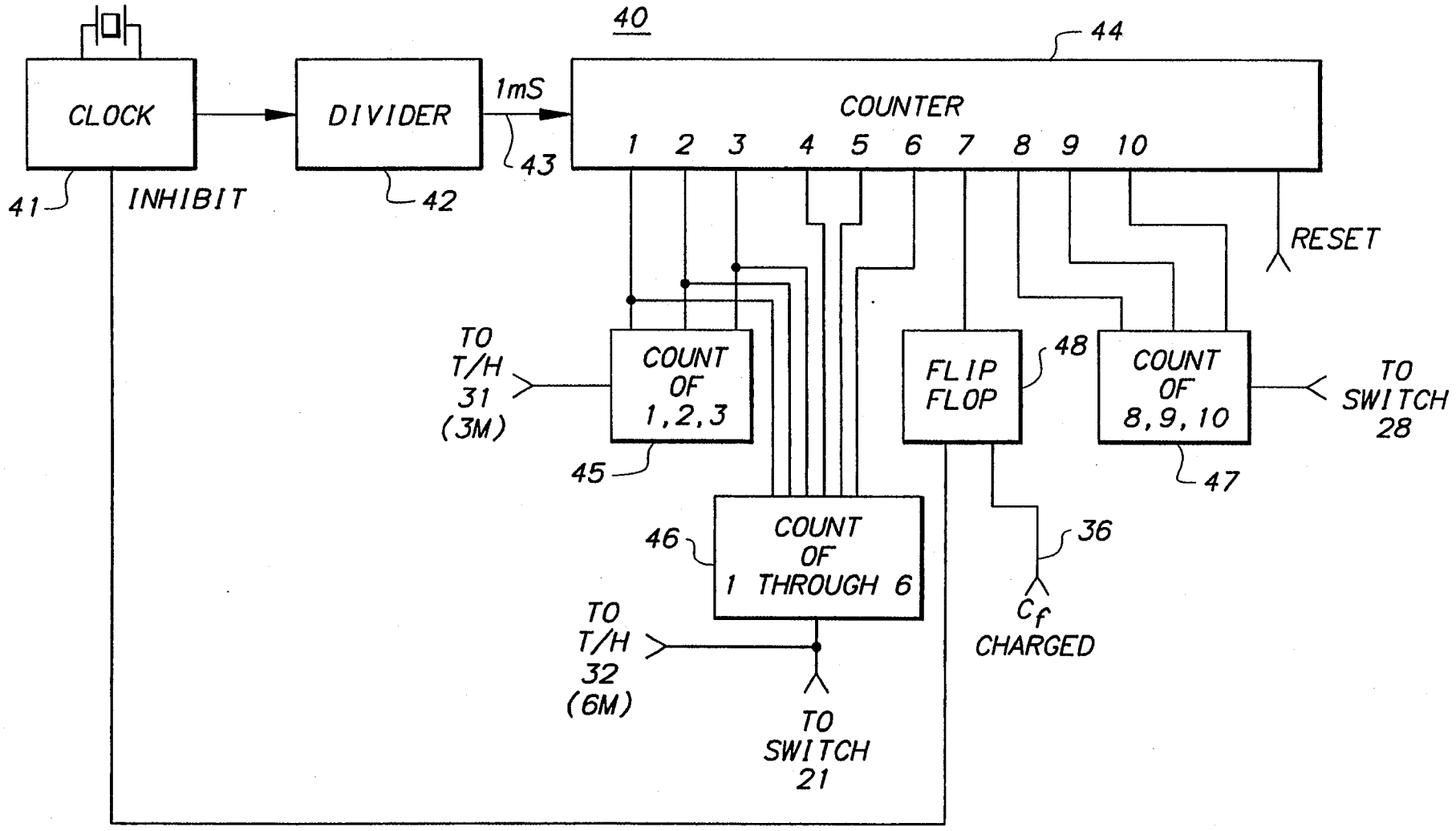
FIG. 7 is a schematic diagram of circuitry for implementing the timer/sequencer of the block diagram of FIG. 3.

Further detail regarding an-implementation of the foregoing, including circuitry for performing such functions, is provided with reference to FIGS. 5A, 5B, 5C, 6 and 7 of the drawings. FIGS. 5A, 5B and 5C illustrate sequential operations of the output stage 11 of the block diagram of FIG. 3. FIG. 6 illustrates operations of the input stage 13 of the block diagram of FIG. 3. FIG. 7 illustrates operations of the timer/sequencer 15 of the block diagram of FIG. 3.

Initially, the above-described timing and control functions are accomplished responsive to the processor 14. As previously indicated, the processor 14 activates the timer/sequencer 15, and provides the output stage 11 with the delay code for defining the required fuze delay. Thereafter, all fuze setting functions are preferably performed by hardware, without the need for processor intervention (although additional processor functions would remain available, if desired).

For convenience in description, these fuze setting functions will be discussed beginning with operations of the output stage 11. With reference to FIG. 5A, and in accordance with the present invention, the assigned delay code is introduced to a D/A converter 20 to develop a dc voltage which is proportional to the desired delay. Activation of the timer/sequencer 15 initially operates a switch 21, which connects the output of the D/A converter 20 to a first amplifier stage 22. Steps are then taken to convert the output of the first amplifier stage 22 from a voltage to a current, by the current driver 23 of FIG. 3. The current driver 23 is implemented as a high voltage amplifier stage 24, which in turn communicates with the node 16 (i.e., the output of the stage 11 and the input to the fuze circuit 12). Also associated with the node 16 is a voltage divider network 25, which establishes a negative feedback path 26 for the current driver 23. A small amount of positive feedback is provided, at 26, to compensate for current losses in the input attenuator 25 and the positive feedback path 27. In the illustrative example previously referred to, the timer/sequencer 15 would maintain this condition for the initial, 6 millisecond charging interval.

Referring now to FIG. 5B, the timer/sequencer 15 then operates both the switch 21, and a second switch 28 connected to an appropriate reference voltage ($V_{REF}$), to apply a portion of the reference voltage to the first amplifier stage 22. An amplifier stage 29 allows the portion of the reference voltage which is ultimately applied to the amplifier stage 22 to be regulated, if desired. The applied reference voltage is converted to a negative current by the high voltage amplifier stage 24. The timer/sequencer 15 maintains this condition until a signal is received from the input stage 13 (to be described more fully below), indicating that the required voltage has been applied to the capacitor $C_f$.

At this point, and referring now to FIG. 5C, the switch 28 is again toggled by the timer/sequencer 15, which in turn causes the output of the D/A converter 20 to be applied to the first amplifier stage 22. The output of the D/A converter 20 is advantageously inverted and amplified by the amplifier stage 29, as desired. The applied output of the D/A converter 20 is then converted to a negative current by the high voltage amplifier stage 24. In the illustrative example previously referred to, the timer/sequencer 15 holds this condition for a period of 3 milliseconds. Following this, the output 16 is set to zero (volts), the fuze setting procedure is complete, and the rocket is ready for firing.

At times, there can be a failure within the fuze circuit 12 that prevents the capacitor $C_t$ from reaching its required voltage. This can be detected by the processor 14, which monitors the status of the fuze delay setting circuit 10 following the allowed fuze setting time. Other faults can be detected by the input stage 13, which monitors the charging characteristics of the capacitor $C_t$ and prevents the timer/sequencer 15 from charging the firing capacitor (the capacitor $C_f$) when the timing capacitor (the capacitor $C_t$) is faulty. This feature can be implemented to prevent short firing of submunitions due to faulty fuzes.

Operations of the input stage 13 will now be described, with reference to FIG. 6. The high voltages applied to the capacitors $C_t$ and $C_f$ make it difficult to implement the necessary analog circuits without first reducing the voltages to a reasonable level. Consequently, the input stage 13 receives its input 30 from the attenuator 25 associated with the node 16. An attenuation of about 2.5 to 1 is generally appropriate for this purpose. All measured voltages will be scaled accordingly.

In conjunction with the above-described operations of the output stage 11 (during the initial, 6 millisecond charging interval exemplified by the circuit configuration of FIG. 5A), the timer/sequencer 15 causes a pair of track and hold circuits 31, 32 to sample the voltage present at the node 16 (i.e., the charging of the capacitor $C_t$). In implementing the illustrative example previously referred to, the track and hold circuit 31 is preferably caused to sample the voltage present at the node 16 after 3 milliseconds (i.e., mid-way through the initial charging interval), while the track and hold circuit 32 is preferably caused to sample the voltage present at the node 16 after 6 milliseconds (i.e., toward the end of the initial charging interval). An analog circuit 33 then uses the reference voltage ($V_{REF}$), and the sampled voltages ($V_1$, $V_2$) taken from the initial charging period for the capacitor $C_t$, to determine the voltage required on the capacitor $C_f$. To this end, the analog circuit 33 of the input stage 13 implements the following analog function:

$$-((V_x-((V_2-V_1)-(((V_2-V_1)*K_1)^2/10)))+((V_1-(V_2-V_1))*2)) \quad (6)$$

Where:

$V_x$=The reference voltage, $V_1$=The voltage measured at the 3 millisecond point during the charging of $C_t$, $V_2$=The voltage measured at the 6 millisecond point during the charging of $C_t$, and $K_1$=A constant.

The primary function of the input stage 13 is to determine when the voltage applied to the capacitor $C_f$ has reached its required level, representing the end of the fuze setting procedure. To this end, the voltage present at the node 16 is detected, at 30, and compared with the resultant of the analog circuit 33. An amplifier 34 is preferably employed for restoration of the attenuated input, at 30. A comparator 35 is employed for purposes of comparing this level with the resultant produced by the analog circuit 33. A successful completion of the charging procedure is signified at 36.

As previously indicated, the above-described operations proceed responsive to signals initiated by the timer/sequencer 15. A circuit 40 for implementing such a timer/sequencer 15 will now be described, with reference to FIG. 7. Suitable timing signals are initiated by a clock circuit 41 (e.g., a crystal oscillator). In implementing the illustrative example previously referred to, a frequency of 1.024 MHz is developed by the clock circuit 41, followed by a reduction to 1.0 KHz by a divider circuit 42 (e.g., a 1024:1 divider). The resulting clock signal, at 43, advantageously provides a 1 ms timing signal to a counter 44 which, in this case, is configured to provide a count of 10 (or at least 10).

The timer/sequencer 15 is initiated (by the processor 14) by causing the counter 44 to reset to zero. This is followed by various counts, for establishing the various timing functions that are desired.

For example, operations of the track and hold circuits 31, 32 are controlled in this fashion. Counts of one, two and three are detected at 45, and serve to operate the track and hold circuit 31. Counts of one through six are detected at 46, and serve to operate the track and hold circuit 32.

Operations of the switches 21, 28 are also controlled in this fashion. Resetting the counter 44 to zero (at the start of the initial charging interval) can be used to provide a signal for toggling the switches 21, 28, to develop the circuit configuration of FIG. 5A in cases where initiation of the switches is necessary or desirable. Counts of one through six are again detected at 46, and serve to operate the switch 21 to develop the circuit configuration of FIG. 5B. Counts of seven through ten are detected at 47, and serve to operate the switch 28 to develop the circuit configuration of FIG. 5C.

Lastly, a flip-flop circuit 48 receives an input from the counter 44, at a count of seven. At a count of seven the flip-flop circuit 48 is set to inhibit the clock 41, preventing further counting until such time as completion of the charging procedure (charging of the capacitor $C_f$) is signified at 36 (see FIG. 6). Upon completion of the charging procedure, the signal 36 is applied to the flip-flop circuit 48, reactivating the clock 41 and allowing the counter 44 to proceed with its count. This proceeds for 3 milliseconds (detected at 47), which provides for final charging of the capacitor $C_f$. Following this (following the count of ten), the charging procedure is complete and the counter 44 stops, until it is reset to initiate another charging cycle (to set another fuze circuit).

Any of a variety of known circuits and circuit components may be used to implement the various functions described above. This is particularly so in implementing the timer/sequencer 15, which can be done in many other ways, and with a variety of different circuit components. However, variations in specifics for implementing the block diagram of FIG. 3, as well as the circuits for implementing the input stage 13 and the output stage 11, are also possible.

Figure 8:
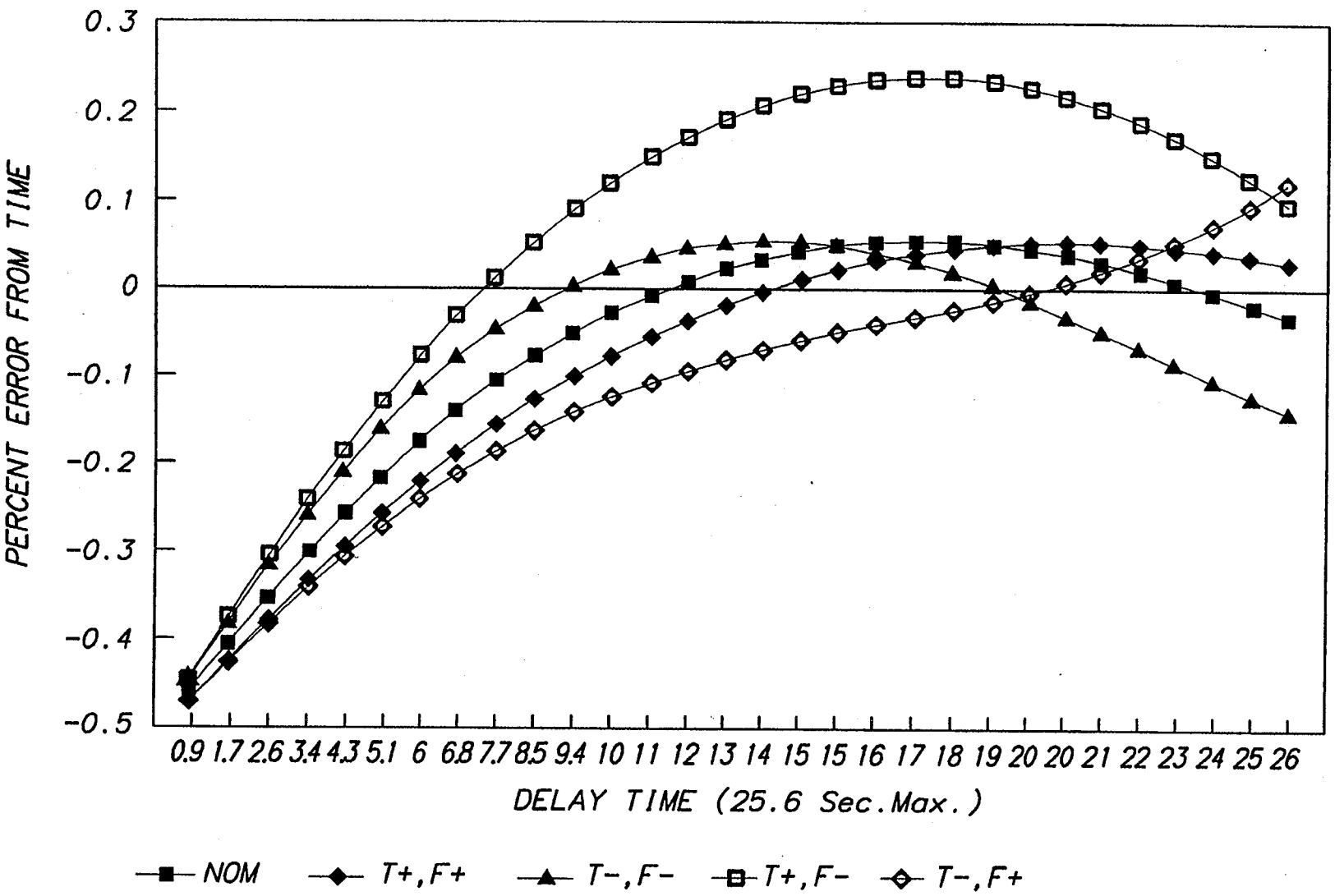
FIGS. 8 to 11 are graphs illustrating computer simulations of operations of typical fuze delay circuits in conjunction with the fuze delay setting circuit of the present invention.
Figure 9:
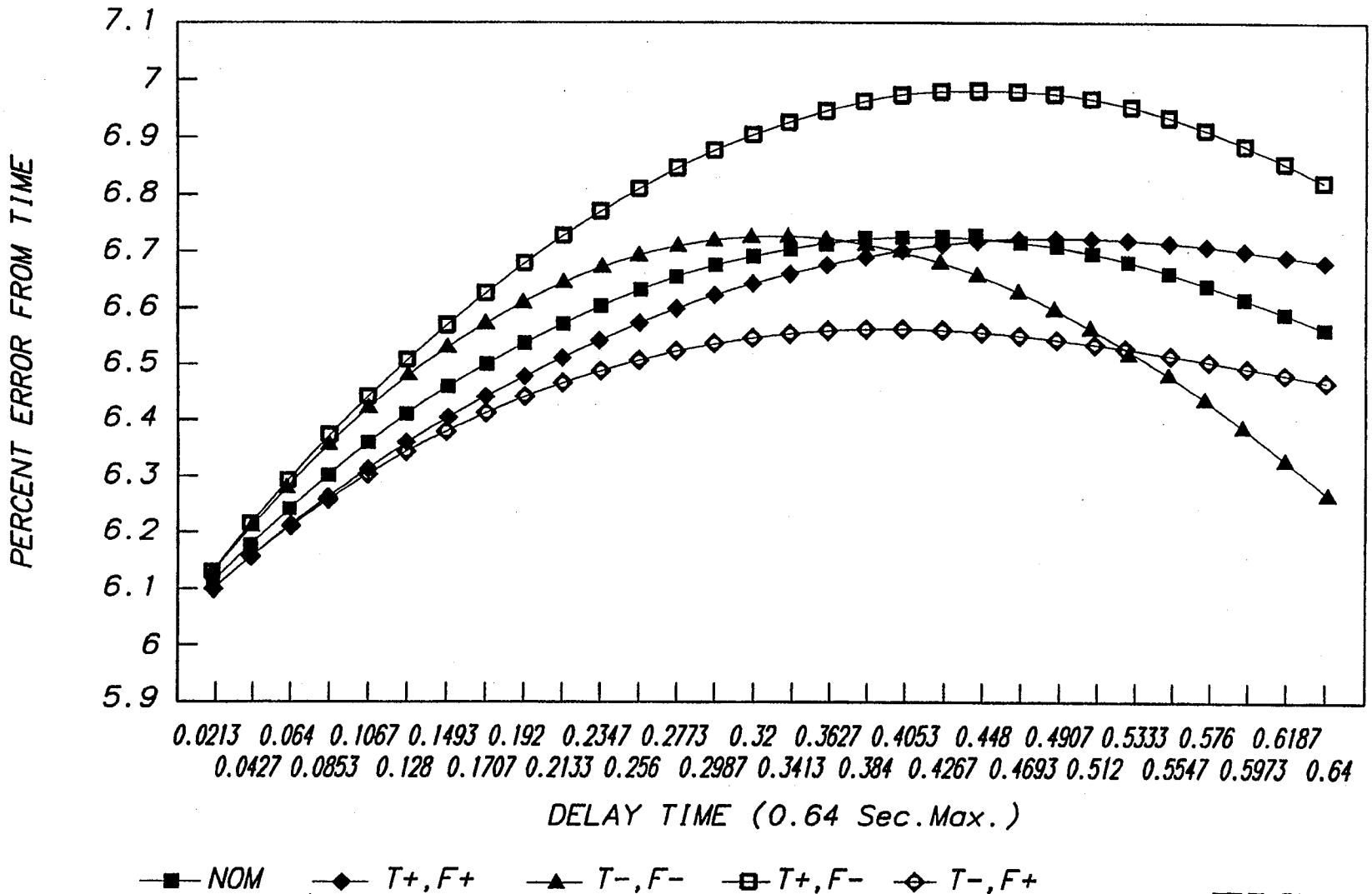
Figure 10:
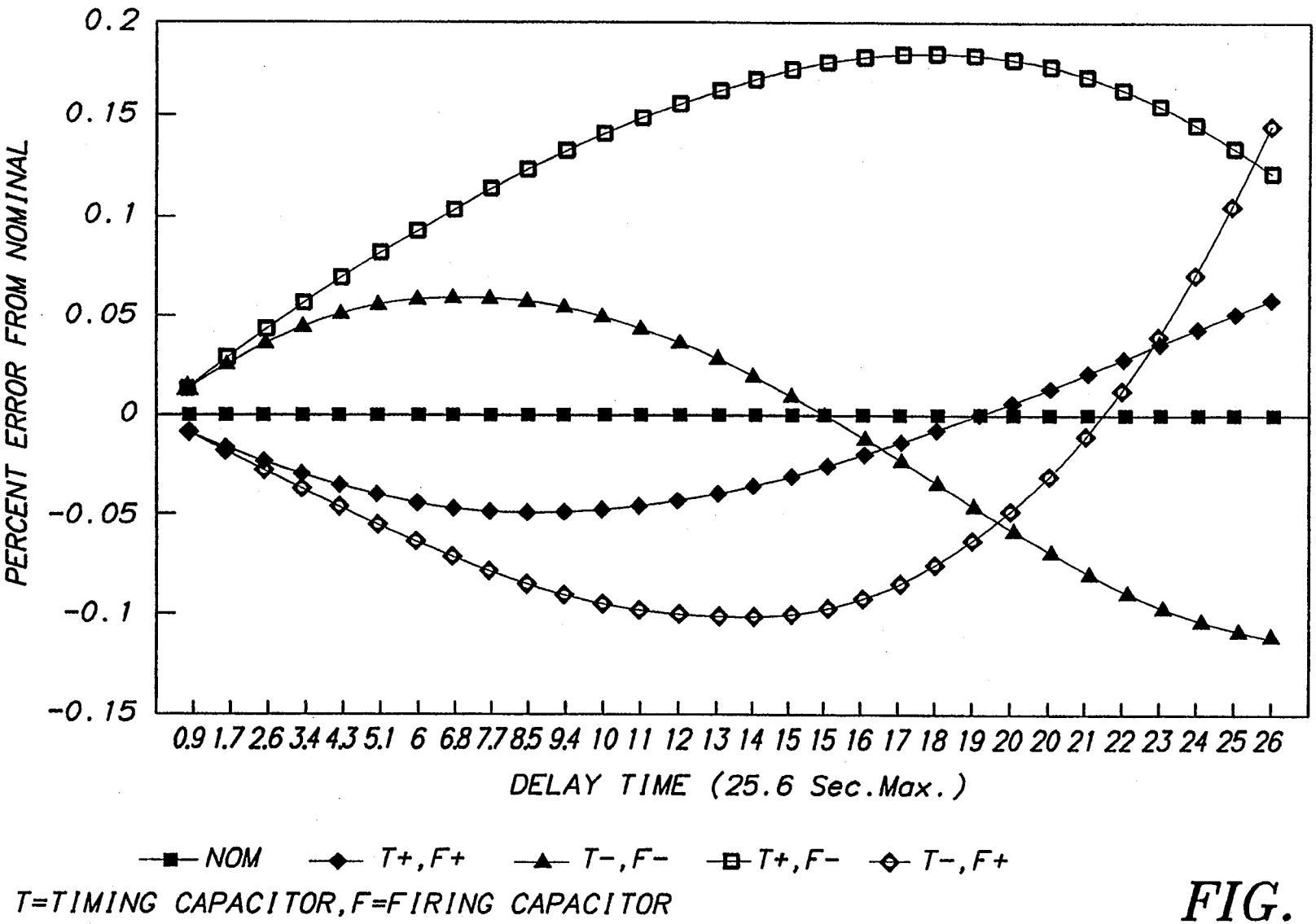
Figure 11:
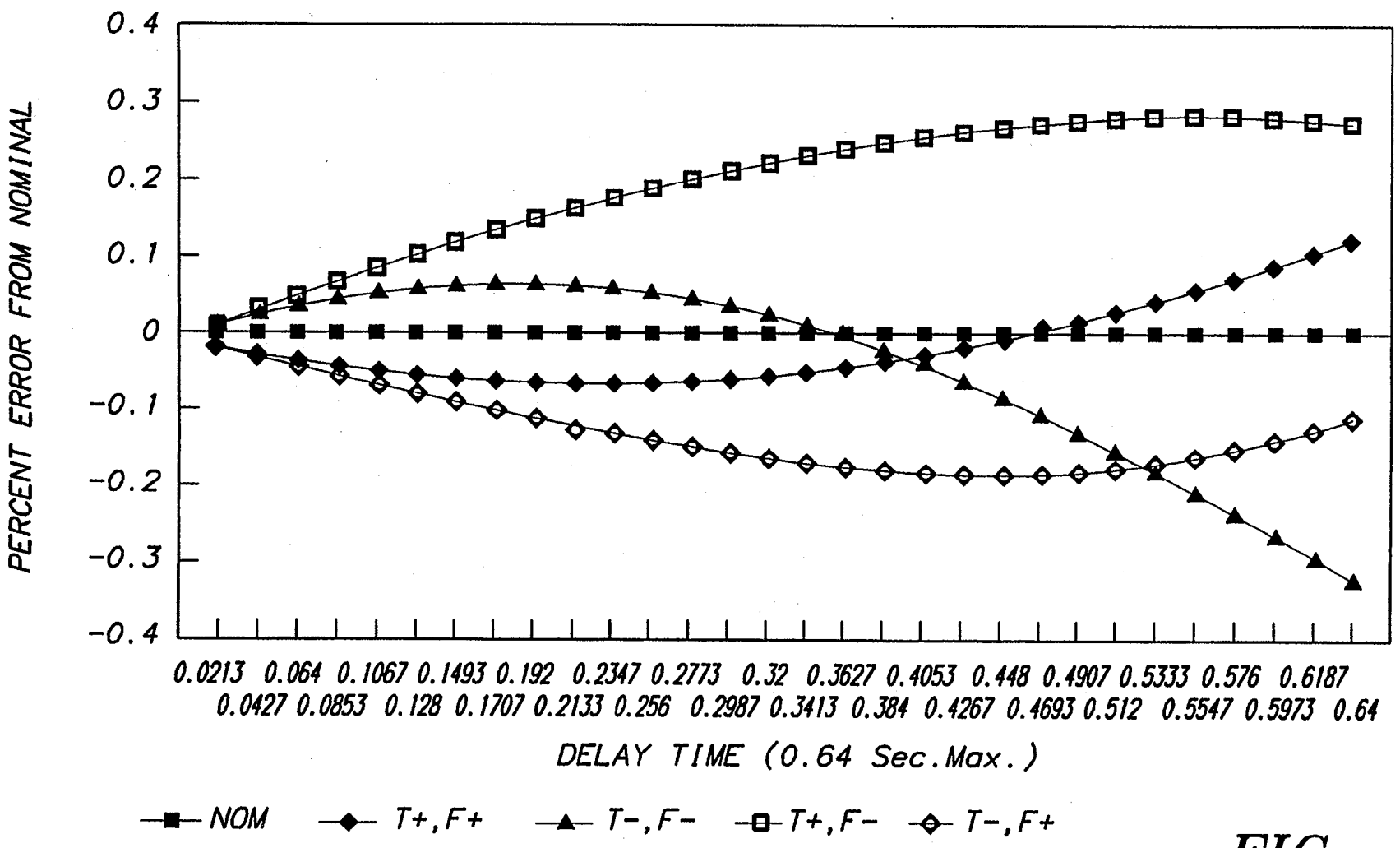

FIGS. 8 to 11 are graphical representations of computer analyses performed to explore projected deviations from desired charge times for capacitors of conventional tolerance (i.e., ±20%). Collectively, FIGS. 8 to 11 indicate that a fuze timing accuracy of better than 1% can be achieved when using the improvements of the present invention with fuze capacitors which vary by more than 20% from their nominal value. Further analysis reveals that most errors follow the same deviation, allowing software to provide additional compensation when fuze delay times are set. As a result, it becomes possible to provide fuze delays that are accurate to better than 0.5%. FIGS. 7 and 8 illustrate calculated time delay errors caused by capacitor combinations that deviate from the nominal value by 20%. FIGS. 9 and 10 illustrate calculated time delay errors that may be obtained with processor compensation for such nominal error deviation. Computer analysis indicates that such compensation characteristics can be applied equally to the M439 Remote Set Fuze and to the M433 Remote Set Fuze. Software scaling of voltages applied to the fuze delay setting circuit, against the required time delay, will provide fuze delay accuracies for the M433 Remote Set Fuze that are comparable to those provided for the M439 Remote Set Fuze.

Moreover, the improvements of the present invention are achievable under varying temperature conditions. This is illustrated by the following table (Table 1), which identifies the error resulting from capacitors at varying conditions responsive to operations of the fuze delay setting circuit 10 at different temperatures. To this end, three measurements were made for each combination of capacitor conditions and temperature conditions, and the worst results were given in Table 1.

TABLE 1

RESULTS OF TEMPERATURE TESTING ON GRIU FUZE SETTER COMPENSATION CHARACTERISTICS

| CONDITIONS | +25 Deg. C. | ERROR (%) | −60 Deg. C. | ERROR (%) | +85 Deg. C. | ERROR (%) |
|---|---|---|---|---|---|---|
| CT = NOM, CF = NOM | 20.0416 | 0.207568 | 20.132 | 0.655673 | 20.1993 | 0.986668 |
| CT = NOM, CF = NOM | 20.1007 | 0.500978 | 20.0614 | 0.30606 | 20.1336 | 0.663567 |
| CT = +25%, CF = NOM | 19.9811 | 0.094589 | 19.9663 | 0.168784 | 20.0756 | 0.376577 |
| CT = −32%, CF = NOM | 19.7255 | 1.3916 | 19.7291 | 1.373099 | 19.8059 | 0.980011 |
| CT = NOM, CF = +25% | 19.863 | 0.689725 | 19.861 | 0.699864 | 19.9601 | 0.199899 |
| CT = NOM, CF = −32% | 20.2339 | 1.155981 | 20.2402 | 1.186747 | 20.3721 | 1.826518 |
| CT = +25%, CF = +25% | 19.7962 | 1.029491 | 19.7933 | 1.044293 | 19.8813 | 0.597043 |
| CT = +25%, CF = −32% | 20.2043 | 1.011171 | 20.1173 | 0.58308 | 20.1908 | 0.944985 |
| CT = −32%, CF = +25% | 19.5895 | 2,09551 | 19.5328 | 2.391874 | 19.6377 | 1.844921 |
| CT = −32%, CF = −32% | 19.9312 | 0.345187 | 20.0766 | 0.381539 | 20.1299 | 0.645301 |
| | MAX ERROR (%) | 2.09551 | | 2.391874 | | 1.844921 |

NOTE:
Three measurements were made for each combination of capacitor values at each temperature and the worst results are given here.

Table 1 reveals that the improvements of the present invention result in minimal time delay errors for varying capacitor condition as well as temperature.

It will be understood that various changes in the details, materials and arrangement of parts which have been herein described and illustrated in order to explain the nature of this invention may be made by those skilled in the art within the principal and scope of the invention as expressed in the following claims.

What is claimed is:

1. An apparatus for charging capacitors associated with a time delay circuit, for establishing a desired time delay, comprising:

means for developing a voltage proportional to the desired time delay;

a current driver circuit coupled with the voltage developing means and the time delay circuit, for receiving the voltage developed by the voltage developing means and for converting the received voltage to a current for application to an input of the time delay circuit, and to the capacitors associated therewith;

means coupled with the input of the time delay circuit, for sampling variations in voltage at the input of the time delay circuit at a plurality of intervals during the application of the current to the time delay circuit; and means coupled with the sampling means and the current driver circuit, for controlling continued charging of the capacitors responsive to the plurality of sampled voltages of the sampling means.

2. The apparatus of claim 1 wherein the voltage developing means is a digital-to-analog converter.

3. The apparatus of claim 2 which further includes a processor in communication with the digital-to-analog converter, for initializing the digital-to-analog converter to develop the voltage proportional to the desired time delay.

4. The apparatus of claim 3 wherein the processor additionally communicates with a timing circuit for sequentially controlling operations of the apparatus.

5. The apparatus of claim 1 wherein the time delay circuit is a fuze circuit for arming a projectile.

6. The apparatus of claim 1 wherein the sampling means are track and hold circuits for sampling voltage at specified intervals.

7. The apparatus of claim 6 wherein the controlling means includes an analog circuit coupled with the track and hold circuits, for receiving signals from the track and hold circuits and for developing a signal responsive thereto, and a comparator coupled with the analog circuit and the input of the time delay circuit, for comparing the signal developed by the analog circuit with signals developed at the input of the time delay circuit.

8. The apparatus of claim 1 wherein the sampling means includes means for determining a difference between the sampled variations in voltage at the input of the time delay circuit.

9. The apparatus of claim 8 wherein the time delay circuit includes two capacitors, and wherein the difference between the sampled variations in voltage is a function of a first of the two capacitors.

10. The apparatus of claim 9 wherein the variations in voltage are sampled during an initial charging interval of about 6 milliseconds.

11. The apparatus of claim 10 wherein the variations in voltage are sampled at 3 milliseconds and at 6 milliseconds.

12. The apparatus of claim 9 wherein the controlling means includes an analog circuit coupled with the sampling means, for receiving signals from the sampling means, and for controlling charging of a second of the two capacitors.

13. The apparatus of claim 12 which further includes a comparator coupled with the analog circuit and the input of the time delay circuit, for comparing signals developed by the analog circuit with signals developed at the input of the time delay circuit.

14. The apparatus of claim 13 wherein the first capacitor and the second capacitor are in operative combination, and wherein the apparatus further includes means for applying a finishing charge to the operative combination of the first capacitor and the second capacitor following charging of the second capacitor.

15. The apparatus of claim 14 wherein the time delay circuit is a fuze circuit for arming a projectile, wherein the first capacitor defines a time delay for the fuze circuit, and wherein the second capacitor operates a detonator associated with the fuze circuit.

16. The apparatus of claim 12 which further includes means for positively charging the first capacitor, and means for negatively charging the second capacitor.

17. The apparatus of claim 1 wherein the current driver is a high voltage amplifier.

18. A method for charging capacitors associated with a time delay circuit, for establishing a desired time delay, comprising the steps of:

developing a voltage proportional to the desired time delay;

converting the developed voltage to a current for application to an input of the time delay circuit, and to the capacitors associated therewith;

sampling variations in voltage at the input of the time delay circuit at a plurality of intervals during the application of the current to the time delay circuit; and controlling continued charging of the capacitors responsive to the plurality of sampled voltages.

19. The method of claim 18 which further includes the step of initializing a digital-to-analog converter to develop the voltage proportional to the desired time delay.

20. The method of claim 19 wherein the initializing further includes the step of sequentially controlling the sampling and the continued charging of the capacitors.

21. The method of claim 18 wherein the time delay circuit is a fuze circuit for arming a projectile.

22. The method of claim 18 which further includes the step of determining a difference between the sampled variations in voltage at the input of the time delay circuit.

23. The method of claim 22 wherein the time delay circuit includes two capacitors, and wherein the difference between the sampled variations in voltage is a function of a first of the two capacitors.

24. The method of claim 23 wherein the sampling occurs during an initial charging interval of about 6 milliseconds.

25. The method of claim 24 wherein the sampling occurs at 3 milliseconds and at 6 milliseconds.

26. The method of claim 23 wherein the controlling includes applying the sampled variations in voltage to an analog circuit for producing a resultant signal, for controlling charging of a second of the two capacitors.

27. The method of claim 26 which further includes the step of comparing the resultant signal produced by the analog circuit with signals developed at the input of the time delay circuit.

28. The method of claim 27 wherein the first capacitor and the second capacitor are in operative combination, and wherein the method further includes the step of applying a finishing charge to the operative combination of the first capacitor and the second capacitor following charging of the second capacitor.

29. The method of claim 28 wherein the time delay circuit is a fuze circuit for arming a projectile, and wherein the method further includes the steps of defining a time delay for the fuze circuit with the first capacitor, and operating a detonator associated with the fuze circuit with the second capacitor.

30. The method of claim 26 which further includes the steps of positively charging the first capacitor, and negatively charging the second capacitor.

* * * * *